US006055669A

United States Patent [19]

Albert

[11] Patent Number: 6,055,669

[45] Date of Patent: May 2, 2000

[54] BOWLING BALL GLOVE

[76] Inventor: David M. Albert, 8448 Colonial Dr., Littleton, Colo. 80124

[21] Appl. No.: 09/169,707

[22] Filed: Oct. 9, 1998

Related U.S. Application Data

[60] Provisional application No. 60/061,435, Oct. 9, 1997.

[51] Int. Cl.[7] ..... A41D 19/00

[52] U.S. Cl. ..... 2/161.1; 2/161.6; 2/161.8; 473/60

[58] Field of Search ..... 2/159, 160, 161.1, 2/161.3, 161.6, 161.7, 161.8, 161.5, 163, 166, 168; 473/54, 60, 106, 109

[56] References Cited

U.S. PATENT DOCUMENTS

| | | |
|---|---|---|
| 2,935,354 | 5/1960 | Chapman . |
| 3,038,723 | 6/1962 | Bergenodorf . |
| 3,046,561 | 7/1962 | Marinese et al. . |
| 3,091,455 | 5/1963 | De Mire . |
| 3,098,654 | 7/1963 | Larsen . |
| 3,224,012 | 12/1965 | Hamm . |
| 3,248,112 | 4/1966 | Metzger . |
| 3,398,951 | 8/1968 | Disko . |
| 3,563,545 | 2/1971 | Rasche . |
| 3,595,575 | 7/1971 | Gooch . |
| 3,606,319 | 9/1971 | Borden . |
| 4,194,736 | 3/1980 | Loafman . |
| 4,273,330 | 6/1981 | Buneta . |
| 4,371,163 | 2/1983 | Shaffer et al. . |
| 4,466,313 | 8/1984 | Gardner . |
| 4,608,720 | 9/1986 | Purin . |
| 5,095,897 | 3/1992 | Clark et al. . |
| 5,330,391 | 7/1994 | Mitchell . |

OTHER PUBLICATIONS

"Comfy Sleeve",™ Silicone Finger Sleeves Brochure, Red's Silicone Extrusions, Inc., 1725 Ocean Ave., Raymond, WA 98577.

Good–Win Super Bowl Gripper Advertisement, Source Unknown, 1973.

Kicker Advertisement, Bowling Magazine, Jun./Jul., 1984.

Kicker Advertisement, Bowling Magazine, Mar., 1984.

Spare–Time Gripper Advertisement, Bowling Magazine, vol. 32, No. 3, 1965.

Super Touch Advertisement, Bowling Magazine, p. 9, Mar. 1980.

*Primary Examiner*—Diana Oleska
*Assistant Examiner*—Kate Moran
*Attorney, Agent, or Firm*—Holland & Hart LLP

[57] ABSTRACT

The control-enhancing material of the present invention includes a plurality of recesses, such as suction cups, positioned on the palm portion of the bowling glove. The areas covered by the control-enhancing material include the underside of the index finger, the underside of the thumb, the underside of the little finger, and the underside of the middle and ring fingers. Basically, the control-enhancing material is positioned at all or some of the areas on the glove that contact the bowling ball when the glove is worn on the hand of the user and the user is holding a bowling ball. The control-enhancing material works to grip the surface of the bowling ball by a suction force and a friction force. The additional grip is maintained even though the user moves his or her hand slightly either away from, towards, or laterally with respect to the bowling ball.

7 Claims, 7 Drawing Sheets

BOWLING BALL GLOVE

This appln. claims the benefit of U.S. Provisional application No. 60/061,435, filed Oct. 9, 1997.

FIELD OF THE INVENTION

This invention relates to bowling aids worn on the hand, and more particularly to gloves used in bowling that have a control-enhancing surface covering at least a portion of the palm and finger regions.

BACKGROUND OF THE INVENTION

Various types of bowling gloves are used to assist in controlling the bowling ball during release, and to help avoid blisters and other physical damage.

Some available gloves have braces built into the glove to keep the user's wrist relatively rigid, and some gloves have braces built into the glove to keep both the user's wrist and index finger relatively rigid. These gloves assist the user in maintaining the proper hand position, but do not improve the contact performance where the bowler's hand engages the bowling ball.

Other available gloves have a frictional material at locations where the user's hand engages the bowling ball. The frictional material helps create a controlling effect on the ball, but is ineffective if the user slightly shifts his or her hand and the frictional material is disengaged from surface of the bowling ball.

It is with these shortcomings in mind that the instant invention was developed.

SUMMARY

The control-enhancing material of the present invention includes a plurality of recesses, such as suction cups, positioned on the palm portion of the bowling glove. The areas covered by the control-enhancing material include the underside of the index finger, the underside of the thumb, the underside of the little finger, and the underside of the middle and ring fingers. Basically, the control-enhancing material is positioned at all or some of the areas on the glove that contact the bowling ball when the glove is worn on the hand of the user and the user is holding a bowling ball. The control-enhancing material works to grip the surface of the bowling ball by a suction force and a friction force to engage the material with the bowling ball. The additional grip is maintained even though the user moves his or her hand slightly either away from, towards, or laterally with respect to the bowling ball, as is explained in more detail below. The control-enhancing material also helps cushion the user's hand from the bowling ball. The control-enhancing material allows the user to have more control during the entire release process.

In more detail, the bowling glove of the present invention engages an outer surface of a bowling ball, the bowling glove including a palm portion, a control-enhancing material attached to the palm portion, and the control enhancing material engaging the bowling ball upon contact through suction and frictional forces.

Further, the bowling glove includes control-enhancing material that has a plurality of suction cups. The bowling glove could also include suction cups each having a flexible stem and an engagement end attached to the stem, the engagement end spaced away from the glove. The engagement end could be concave. The suction cups can be attached to a base material, with the base material being attached to the glove.

Other aspects, features and details of the present invention can be more completely understood by reference to the following detailed description in conjunction with the drawings, and from the appended claims.

DETAILED DESCRIPTION OF THE PREFERRED EMBODIMENT

Figure 5:
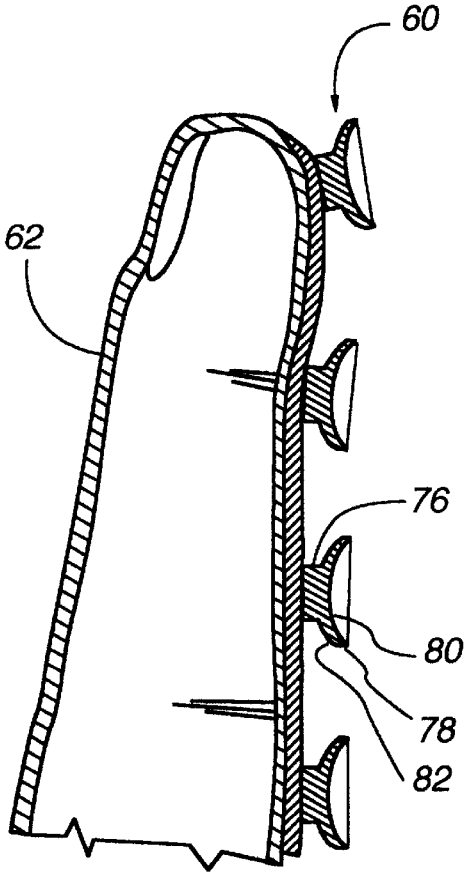
FIG. 5 is a section taken along line 5—5 of FIG. 2.
Figure 6:
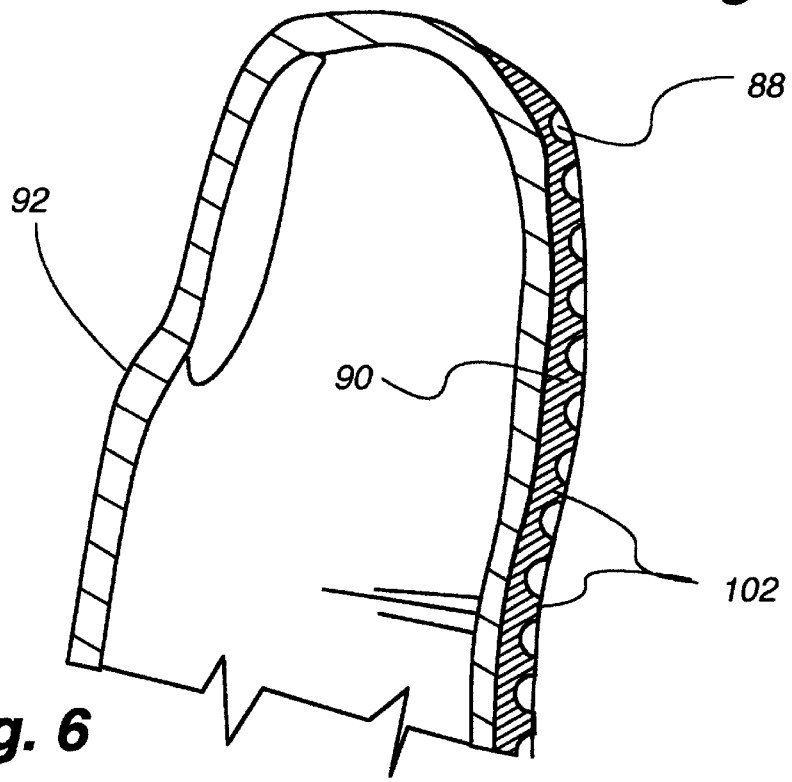
FIG. 6 is a section taken along line 6—6 of FIG. 3.
Figure 7A:
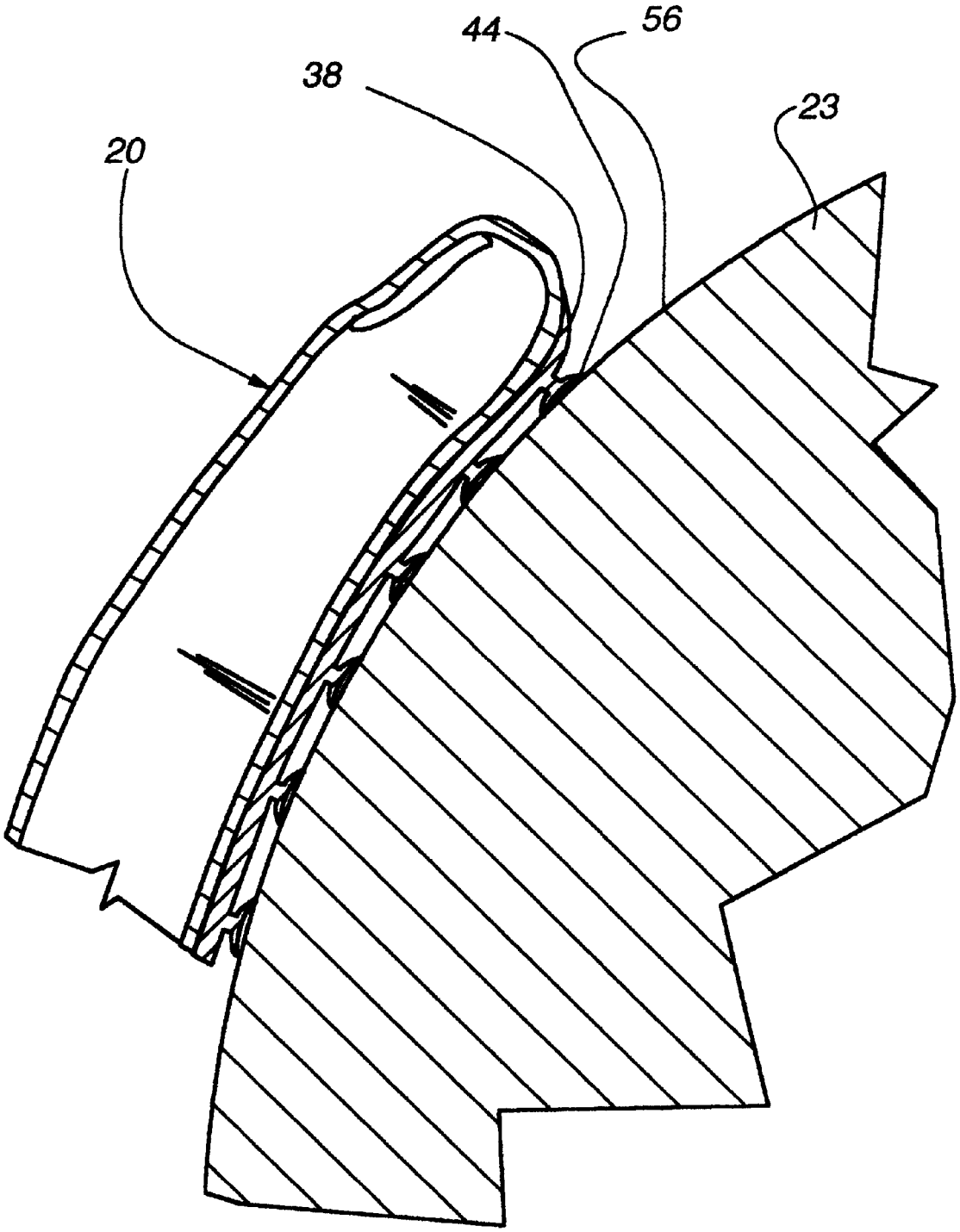
FIG. 7 is a section view of the first, second and third embodiments of the present embodiment in engagement with the outer surface of a bowling ball.
Figure 7B:
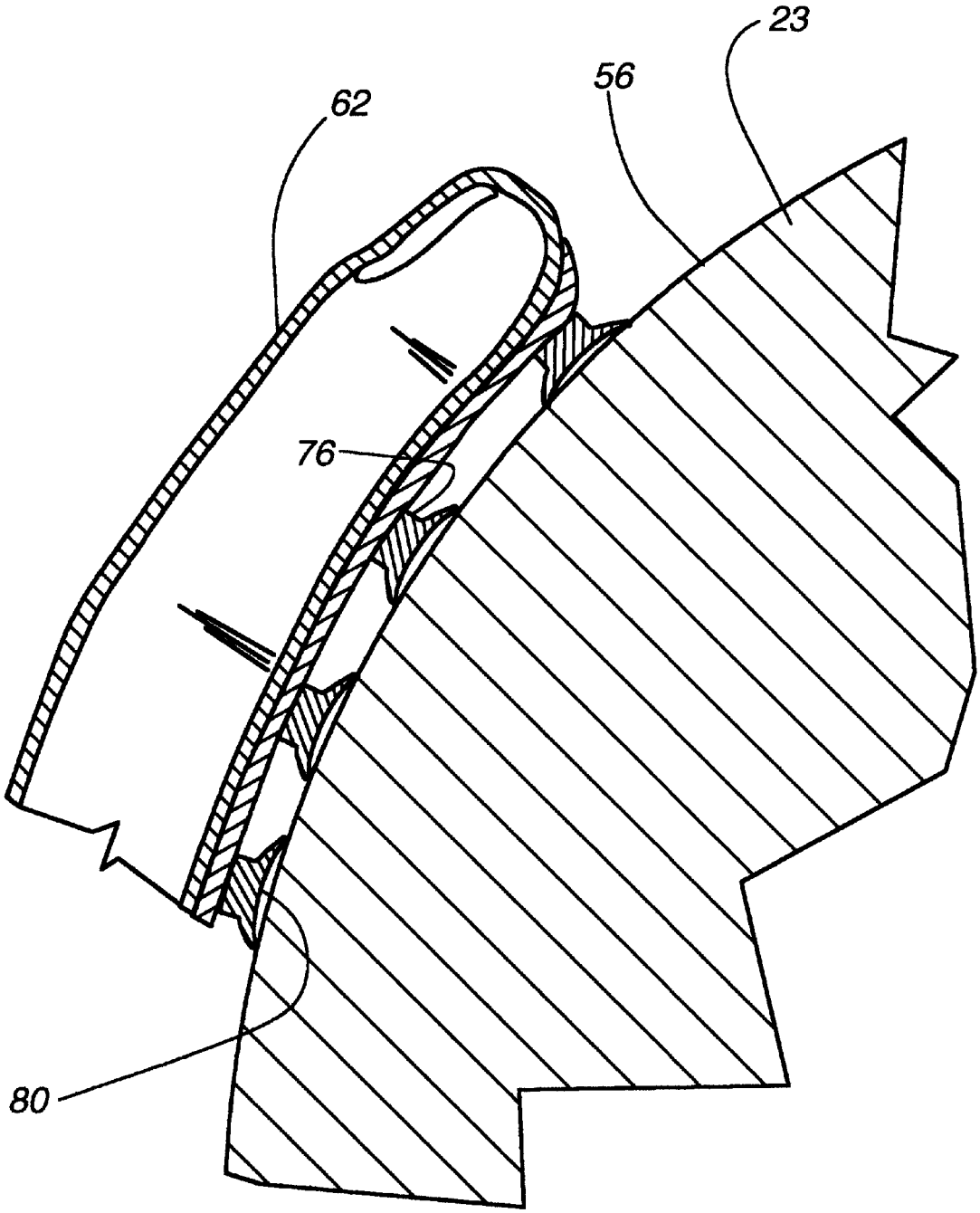
Figure 7C:
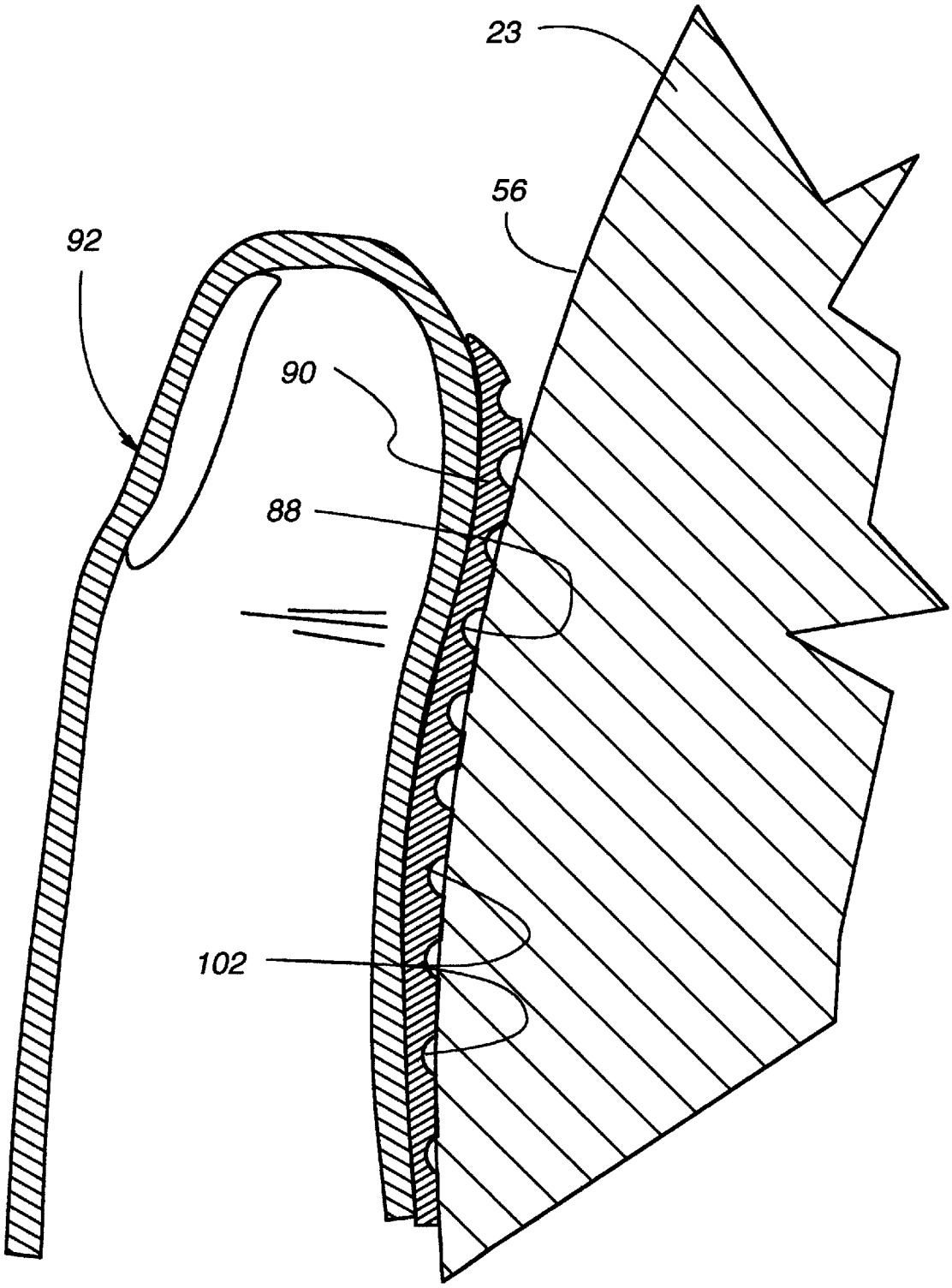

FIGS. 1–7 show a bowling glove 20 with controlling surfaces attached to the palm side 22 of the glove to enhance the user's control of the bowling ball 23 (see FIG. 7). The glove is typically made of a leather, vinyl, or other suitable material, and has an adjustable closure around the base rim 24, such as a hook-and-loop material clasp, such as Velcro®. Typical bowling gloves have a palm portion 26 including an index finger 28, a little finger 30, a truncated middle 32 and ring 34 fingers, and truncated thumb 36 portions. On the middle and ring finger portions the glove extends up to the first knuckle of the finger, and on the thumb portion the glove typically extends only over the base knuckle of the thumb. The glove also has a back side portion, which extends across the back of the hand and attaches on either side to the palm portion.

The control-enhancing 38 material of the present invention includes a plurality of recesses 40, such as suction cups, positioned on the glove 20 on the palm portion 26, including the underside of the index finger portion 28, the underside of the little finger portion 30, and the underside of the middle 32 and ring 34 fingers. Basically, the control-enhancing material is positioned at all or some of the areas on the glove 20 that contact the bowling ball when the glove is worn on the hand of the user and the user is holding a bowling ball.

The control-enhancing material 38 works to grip the surface of the bowling ball 23 by a suction force and a friction force. The additional grip is maintained even though the user moves his or her hand slightly either away from, towards, or laterally with respect to the bowling ball 23, as is explained in more detail below. The control-enhancing material 38 also helps cushion the user's hand from the bowling ball. The control-enhancing material 38 allows the user to have more control during the entire delivery of the bowling ball.

Figure 1:
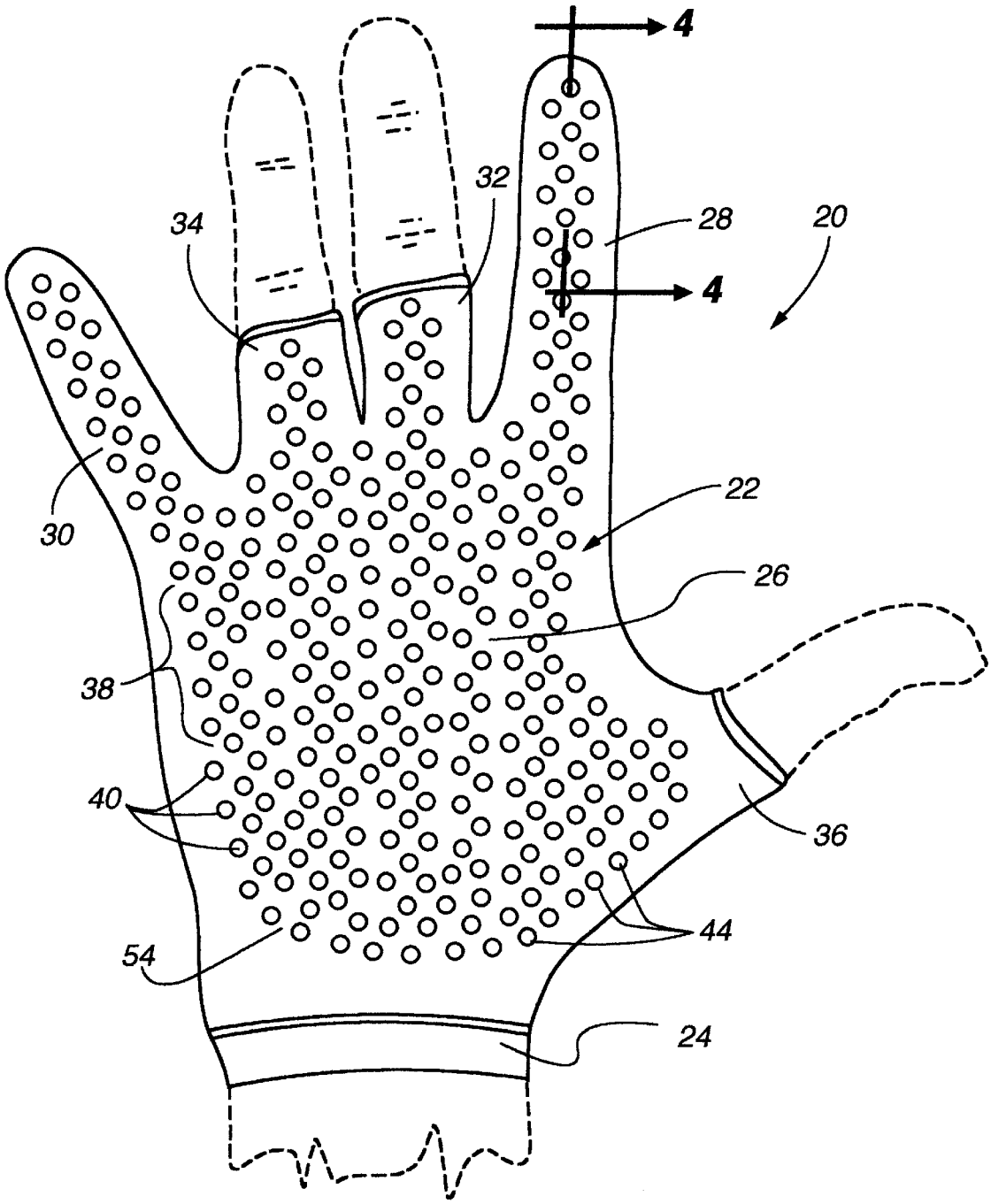
FIG. 1 shows a bowling glove incorporating the suction cups of a first embodiment of the present invention.
Figure 4:
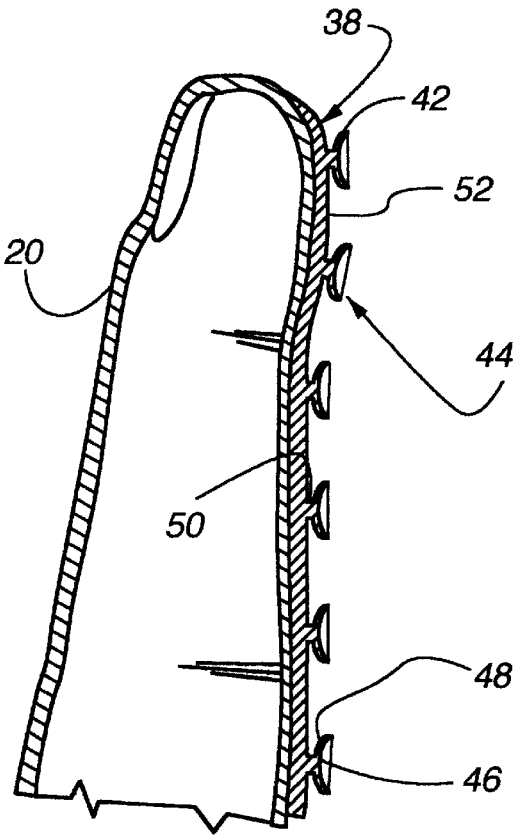
FIG. 4 is a section taken along line 4—4 of FIG. 1.

FIGS. 1 and 4 show a first embodiment of the present invention. A plurality of relatively small, preferably 1/16 of an inch to 1/4 of an inch in diameter across the engagement end 42, suction cups 44 are mounted on the palm portion 26, including under the index 28, little 30, thumb 36 and portions of the middle 32 and ring 34 fingers. The suction cups 44 are positioned at a relatively high density, such as preferably between 14 and 18 per square inch. This size and density of suction cups provides for a relatively smooth release when the bowling ball disengages from the control-enhancing material because the suction cups are relatively small.

The suction cups 44 each have an engagement end 42 shaped with a concave side 46 facing outwardly and a convex side 48 facing toward the palm portion 26. A preferably flexible pedestal 50 extends from the convex side of the engagement end to a base material 52. The base material 52 is preferably the same material as the suction cups, and is flexible. The base material helps support the suction cup 44 and maintains their spacing relative to one another. The base material is fixedly or releasably attached to the glove 20 in the appropriate desired locations. The base material 52 and the suction cups 44 are preferably formed of a flexible resilient material, such as urethane or plastic.

While the suction cups are preferably located as described above, they can be positioned only on the desired location, for instance on the fingers and not on the palm. A hook and loop fastener, such as Velcro®, can be used to attach the base material 52, and as such the suction cups 44, to the desired location on the glove 20. This allows the user to custom-position the suction cups 44 for the most effect. The area of the glove 20 covered by the control-enhancing material 38, whether over the entire surface of the palm portion 26 or only under one finger, is hereinafter referred to as the "control area" 54 (see FIG. 1).

When the control area 54 is engaged with the outer surface of a bowling ball, the suction cups 44 engage and attach to the continuously curving bowling ball surface 56 (see FIG. 7). Since the engagement end 42 of the suction cups 44 are positioned on flexible pedestals, they extend away from the glove 20. The suction cups 44 thus can stay connected to the surface 54 of the bowling ball even though the hand or finger is pulled away slightly from, pushed towards, or moved laterally with respect to the bowling ball. The pedestal 50 for each suction cup 44 flexes to allow the hand to move relatively independently from the engagement end 42 of each of the suction cups 44. Each suction cup 44 attaches independently at discrete locations to the surface 54 of the bowling ball 23.

This is an advantageous over existing sticky surface gloves where a slight movement of the finger or hand away from the bowling ball disengages the sticky surface from the outer surface of the bowling ball. For instance, the tip of the index finger is often not in direct engagement with the outer surface of the bowling ball, but is instead slightly raised off the outer surface of the bowling ball. With the present invention, the suction cups near the tip of the index finger will remain intact with the bowling ball since they each extend away from the surface of the glove and allow the finger to be lifted slightly off the surface of the bowling ball without disengaging the suction cups.

In FIG. 1, the relatively small sized suction cups extend along the under surface of the index finger 28, the little finger 30, below the thumb 36, across the palm, and extend up the middle 32 and ring 34 fingers. The extension of the suction cups 44 away from the surface of the base material 38 allows for lateral adjustment as well as vertical adjustment and movement of the suction cups 44 once applied to the outer surface of the bowling ball to facilitate a more complete connection of the suction cups 44 to the bowling ball with respect to the position of the finger or hand.

When the bowling ball 23 is released from the hand of the user, the suction cups 44 each individually disconnect from the surface 54 of the bowling ball 23. During the delivery movement (back swing, down swing and release), the suction cups keep the user in closer control of the bowling ball, and assist in increasing rotation, accurate handling and positioning of the bowling ball during the delivery movement.

Figure 2:
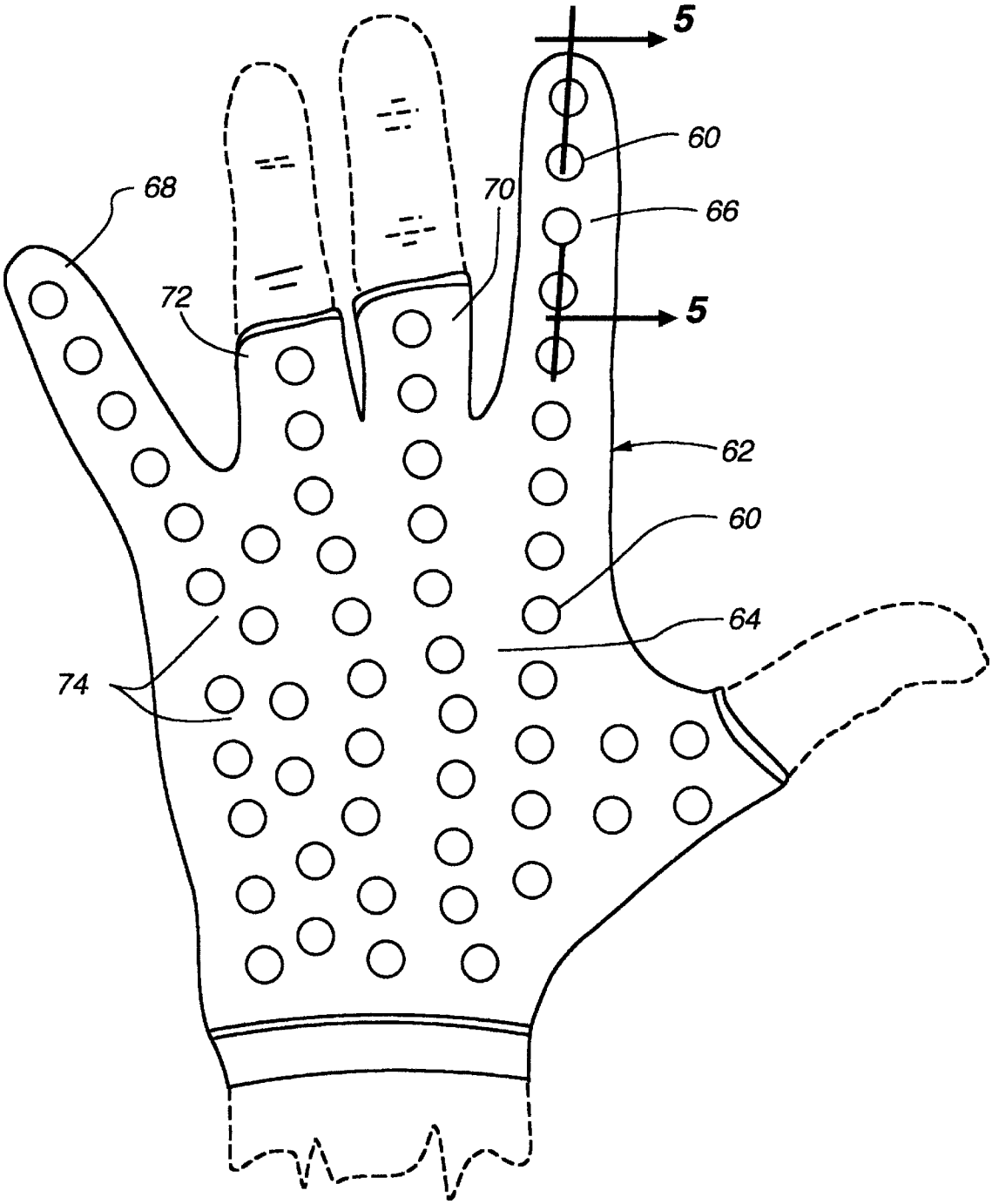
FIG. 2 shows a bowling glove incorporating the suction cups of a second embodiment of the present invention.

FIGS. 2 and 5 show a second embodiment of the present invention where the suction cups 60 are relatively larger than in the first embodiment and are preferably directly attached to the material of the glove 62. The general construction and operating of the glove and the suction cups is similar to that described in the first embodiment. The suction cups 60 (new reference numerals are used for clarity) have the same construction as those previously described, and can be individually attached by adhesive, sewing or the like to the glove as desired. The suction cups 60 still extend along the palm 64, along the underside of the index 66 and little 68 fingers, as well as on the portions of the glove covering the middle 70 and ring 72 fingers. The suction cups 60 together form the control-enhancing material, and the area covered by the suction cups is considered the control area. These relatively larger suction cups 60 are preferably approximately ¼ of an inch to ½ of an inch in diameter. The larger suction cups are spaced further apart than in the first embodiment, such as preferably approximately 41 7 suction cups per square inch. This size and density of suction cups 60 provides for a relatively less smooth release when the bowling ball 23 disengages from the control-enhancing material 74 because the suction cups 60 are relatively larger.

The suction cups 60 each have a flexible stem 76, and an engagement end 78 defining a concave surface 80 and a convex surface 82. As with the first embodiment, these suction cups 60 still allow relative movement of the finger or hand away from or toward the ball, or laterally with respect to the ball without disengaging the attachment of the suction cup to the outer surface of the bowling ball. The suction cups are individually formed of a plastic or urethane material, or other suitable material. The suction cups can also be attached on a unitary base material if desired, as the first embodiment. In addition, the larger suction cups can be positioned only in particular locations as desired, as described above with regard to the first embodiment.

Figure 3:
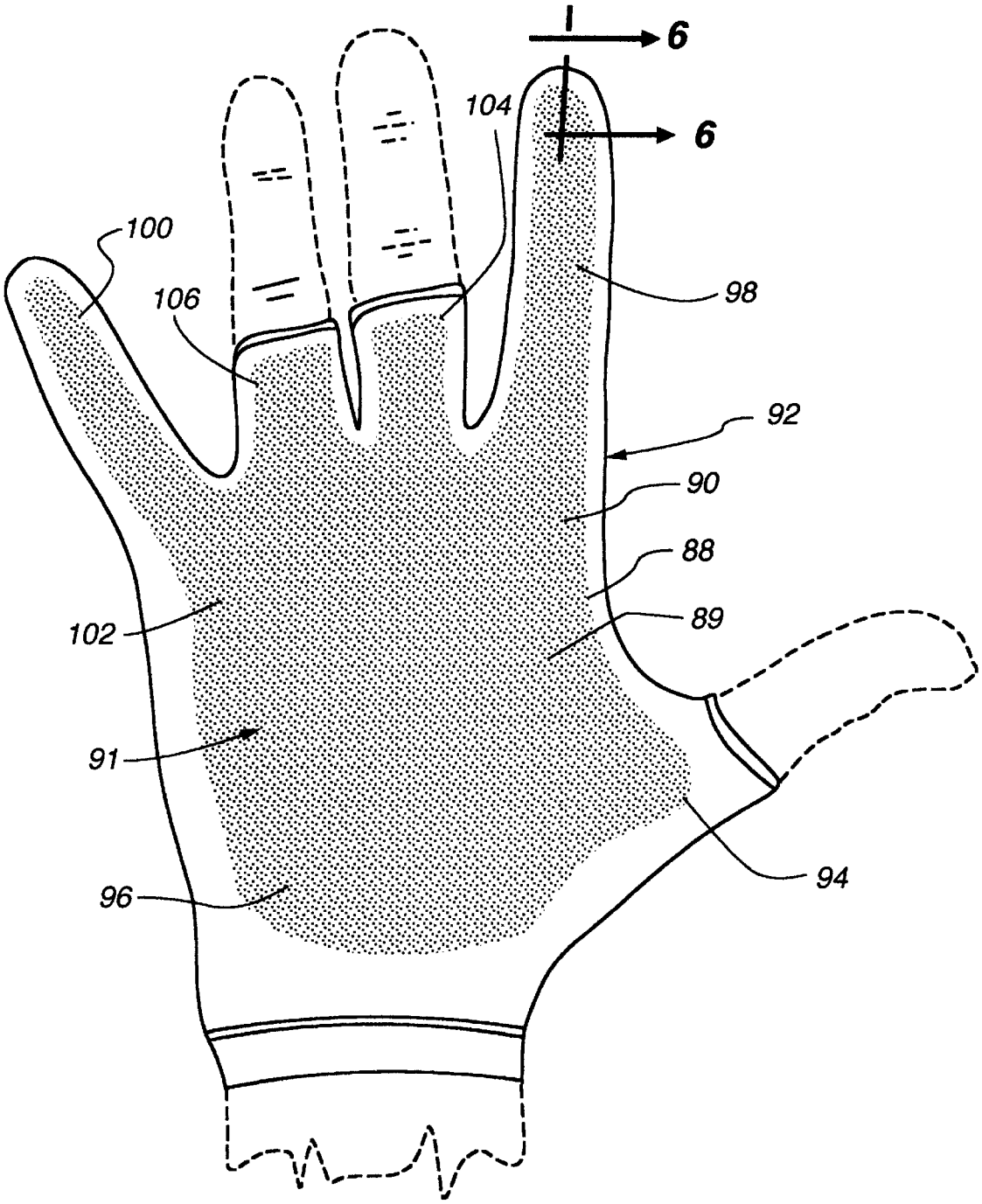
FIG. 3 shows a bowling glove incorporating the suction cups of a third embodiment of the present invention.

FIGS. 3 and 6 show another embodiment of the present invention where the suction cups are each formed by an individual recesses 88 in a base material. The general operating of the glove and the suction cups is similar to that described in the first embodiment. The base material 90 can be of uniform thickness or varying thickness. The base material 90 is applied and attached, either fixedly or removably, to the glove 92 below the thumb 94, along the palm 96, along the underside of the index 98 and little 100 fingers, and along the underside of the middle 104 and ring 106 finger where covered by the glove. The recesses 88 together form the control-enhancing material 89, and the area covered by the recesses is considered the control area 91. The recesses 88 formed in the base material 90 act as suction cups and are smaller than the suction cups of the first and second embodiments. They also provide a suction and frictional attachment to the outer surface 54 of the bowling ball 23 to provide additional control during delivery. The base material 90 is a plastic or polyurethane material, or other suitable material that is flexible and compressible. The base material 90, being flexible, allows slight movement of the glove with respect to the bowling ball without affecting the contact of the base material to the outer surface 54 of the bowling ball 23.

The recesses 88 are preferably circular and approximately 1/64 of an inch to ⅛ of an inch in diameter. The recesses are formed at a density level of between 180 and 300 recesses per square inch, preferably 250. The portion 102 of the base material 90 between the recesses 88 acts to enhance the frictional engagement between the glove 92 and the outer surface 54 of the bowling ball 23.

FIG. 6 shows the recesses 88 in section. The recesses 88 are concave having a generally semicircular shape. The recesses 88 are preferably approximately 1/64 to 1/32 of an inch deep. This size and density of recesses provides for a smooth release when the bowling ball disengages from the control-enhancing material because the suction cups are smaller.

FIG. 7 shows a representative cross-section of the first, second, and third embodiment. The suction cups of the respective embodiments are applied to the outer surface 54 of the bowling ball 23 and follow the curvature of the outer surface of the bowling ball continuously. As can be seen, the suction cups position themselves in a generally curved orientation to exactly match the outer surface of the bowling ball and provide excellent engagement with the bowling ball. In addition, since the suction cups extend from the finger and hand of the user, and are flexible, the user's slight movement of the finger toward and away from the surface of the bowling ball or laterally with respect to the surface of the bowling ball does not necessarily disengage the suction cups from the surface of the bowling ball.

With respect to the first and second embodiments, the suction cup engagement end extends from the glove on a pedestal, which spaces the engagement ends away from the finger and allows for the flexibility in hand and finger positioning. As the ball is released, the force of the ball leaving the hand overcomes the attachment and controlling force created by the suction cups. While engaging the bowling ball, the control-enhancing material imparts additional force to the bowling ball to improve the user's control and revolution generation. The suction cups can be of a circular shape, oval shape, or other suitable shape, with the circular or oval shapes being preferred.

While the invention has been particularly shown and described with reference to a preferred embodiment thereof, it will be understood by those skilled in the art that various other changes in the form and details may be made without departing from the spirit and scope of the invention.

Presently preferred embodiments of the present invention and many of its improvements have been described with a degree of particularity. It should be understood that this description has been made by way of example, and that the invention is defined by the scope of the following claims.

I claim:

1. A bowling glove for engaging an outer surface of a bowline ball, said glove comprising:

a palm portion:

a control-enhancing material attached to said palm portion, said control-enhancing material including a base material forming a plurality of recesses therein, said recesses formed at a density of approximately 180 to 300 per square inch, wherein said control enhancing material engages the bowling ball upon contact through suction and frictional forces.

2. A bowling glove as defined in claim 1 wherein said recesses are formed at a density of approximately 250 per square inch.

3. A bowling glove as defined in claim 1 wherein said recesses are approximately $1/64^{th}$ to $1/32^{nd}$ of an inch deep.

4. A bowling glove for engaging an outer surface of a bowline ball, said glove comprising:

a palm portion:

a control enhancing material attached to said palm portion, said control enhancing material including a plurality of suction cups, said suction cups formed at a density of 14 to 18 per square inch, wherein said control enhancing material engages the bowling ball upon contact through suction and frictional forces.

5. A bowling glove as defined in claim 4 wherein said suction cups are approximately 1/16 to 1/4 inches in diameter.

6. A bowling glove for engaging an outer surface of a bowling ball, said glove comprising:

a palm portion:

a control enhancing material attached to said palm portion, said control enhancing material including a plurality of suction cups, said suction cups formed at a density of 4 to 7 per square inch, wherein said control enhancing material engages the bowling ball upon contact through suction and frictional forces.

7. A bowling glove as defined in claim 6 wherein said suction cups are approximately 1/4 to 1/2 inches in diameter.

* * * * *